United States Patent [19]

Bernier et al.

[11] Patent Number: 4,939,490

[45] Date of Patent: Jul. 3, 1990

[54] MOLDED CASE CIRCUIT BREAKER BELL ALARM UNIT

[75] Inventors: Richard E. Bernier, Southington; Joseph G. Nagy, Plainville, both of Conn.

[73] Assignee: General Electric Company, New York, N.Y.

[21] Appl. No.: 311,794

[22] Filed: Feb. 17, 1989

[51] Int. Cl.[5] ..... H01H 73/12

[52] U.S. Cl. ..... 335/17; 335/202; 340/638

[58] Field of Search ..... 335/17, 202, 132; 200/293; 340/638, 639; 361/428

[56] References Cited

U.S. PATENT DOCUMENTS

| | | | |
|---|---|---|---|
| 4,209,761 | 6/1980 | Klein et al. | 335/17 |
| 4,297,663 | 10/1981 | Seymour et al. . | |
| 4,589,052 | 5/1986 | Dougherty . | |
| 4,604,613 | 8/1986 | Clark | 340/638 |
| 4,622,444 | 11/1986 | Kandatsu et al. . | |
| 4,641,225 | 2/1987 | Reichle | 361/428 |
| 4,679,019 | 7/1987 | Todaro et al. . | |
| 4,700,161 | 10/1987 | Todaro et al. . | |
| 4,728,914 | 3/1988 | Morris et al. . | |
| 4,786,885 | 11/1988 | Morris et al. . | |
| 4,788,621 | 11/1988 | Russell et al. . | |
| 4,794,356 | 12/1988 | Yu et al. . | |
| 4,806,893 | 2/1989 | Castonguay et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is an electronic trip circuit breaker which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components. Additionally, a bell alarm signal unit can be incorporated within the trip actuator and multiple accessory unit enclosure.

8 Claims, 5 Drawing Sheets

(ON)

(TRIPPED)

MOLDED CASE CIRCUIT BREAKER BELL ALARM UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which Patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. No. 4,700,161 entitled "Combined Trip Unit and Accessory Module for Electronic Trip Circuit Breakers". The aforementioned U.S. Patents which represent the advanced state of the art of circuit protection devices are incorporated herein for reference purposes.

A shunt trip accessory unit allows the circuit breaker operating mechanism to be articulated to separate the circuit breaker contacts, usually to perform a tripping function for electrical system control and protection. One such shunt trip accessory unit is described within U.S. Pat. No. 4,786,885 entitled "Molded Case Circuit Breaker Shunt Trip Unit". An auxiliary switch accessory unit allows an operator to determine the "ON" or "OFF" conditions of a molded case circuit breaker contacts at a remote location by means of an audible alarm or visible display. One such auxiliary switch unit is described within U.S. Pat. No. 4,794,356 entitled "Molded Case Circuit Breaker Auxiliary Switch Unit". Both of the aforementioned U.S. Patents are incorporated herein for purposes of reference.

A more recent example of a combined overcurrent trip actuator and multiple accessory unit is described within U.S. Pat. No. 4,788,621 entitled "Molded Case Circuit Breaker Multiple Accessory Unit" which combined overcurrent trip actuator and multiple accessory unit requires a separate mounting recess within the circuit breaker cover to house the printed wire board that carries the accessory control circuit. This Patent is incorporated herein for reference purposes.

U.S. Pat. No. 4,806,893 describes a molded case circuit breaker actuator-accessory unit wherein the integrated overcurrent trip actuator and multiple accessory unit containing the control electronics and mechanical interface components are contained on a single structure mounted within a single recess. This Patent is also incorporated herein for reference purposes.

For purposes of this disclosure, an "electronic circuit interrupter" shall mean a molded case circuit breaker that contains an electronic trip unit within a common enclosure with the operating mechanism and the interruptable contacts. A bell alarm unit is a useful accessory when such an electronic circuit interrupter is used within an industrial environment and it is important to know when a piece of manufacturing equipment has been shut down due to interruption of the electric power either by manual or automatic intervention. A space problem is involved in providing an electronic circuit interrupter with a bell alarm unit when the electronic circuit interrupter already contains more than one accessory device. Often times a user would have to select between accessories in view of the limited available space.

One purpose of this invention is to describe a bell alarm accessory that requires a minimum amount of space and allows use within one or more additional accessories within a common electronic circuit interrupter enclosure.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions in combination with a bell alarm accessory and is arranged within one part of the enclosure. The printed wire board containing the accessory control circuit is arranged on the actuator-accessory unit along with the bell alarm accessory.

DESCRIPTION OF THE PREFERRED EMBODIMENT

Figure 1:
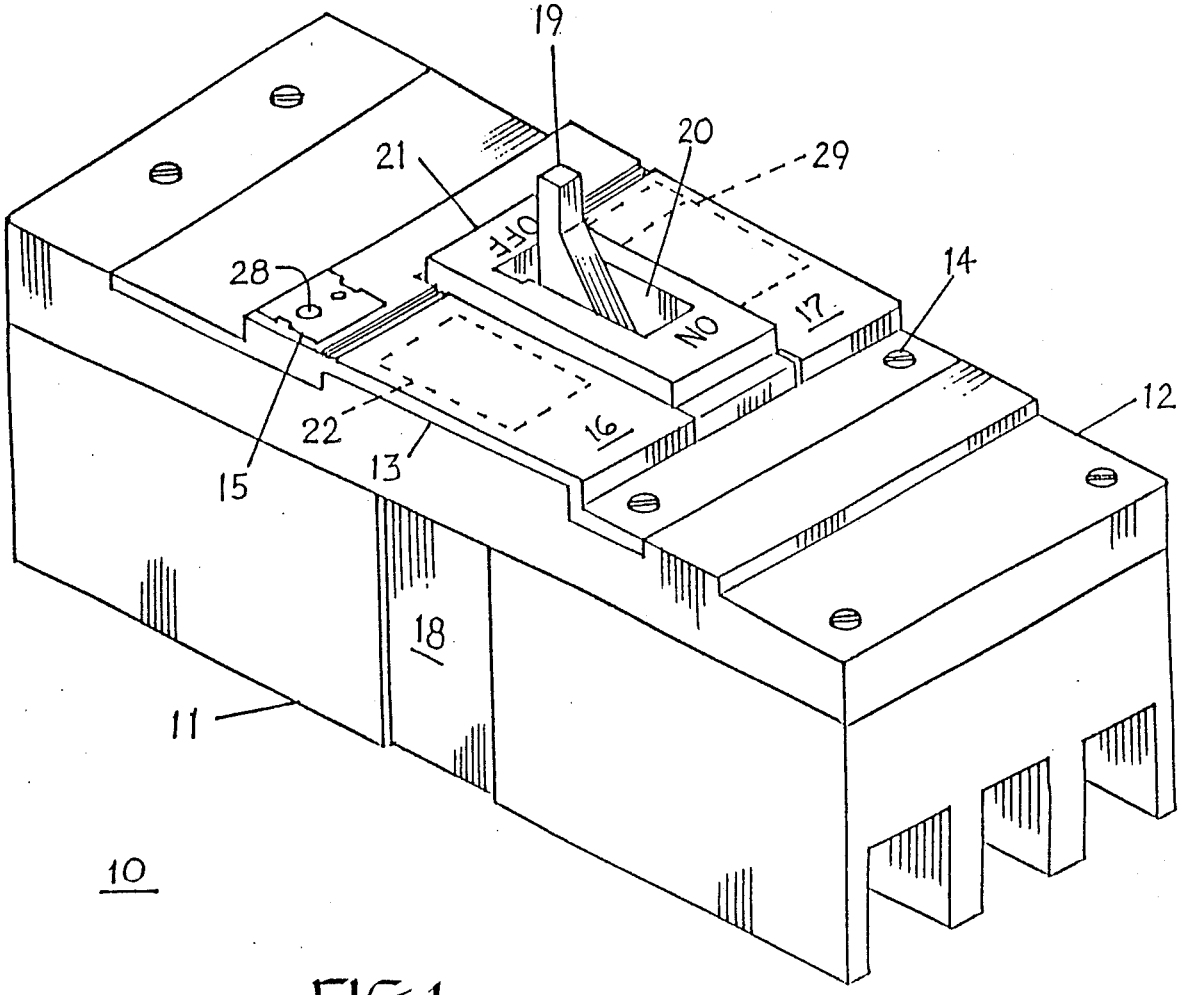
FIG. 1 is a top perspective view of an electronic trip circuit breaker containing selected accessory functions according to the invention.
Figure 2:
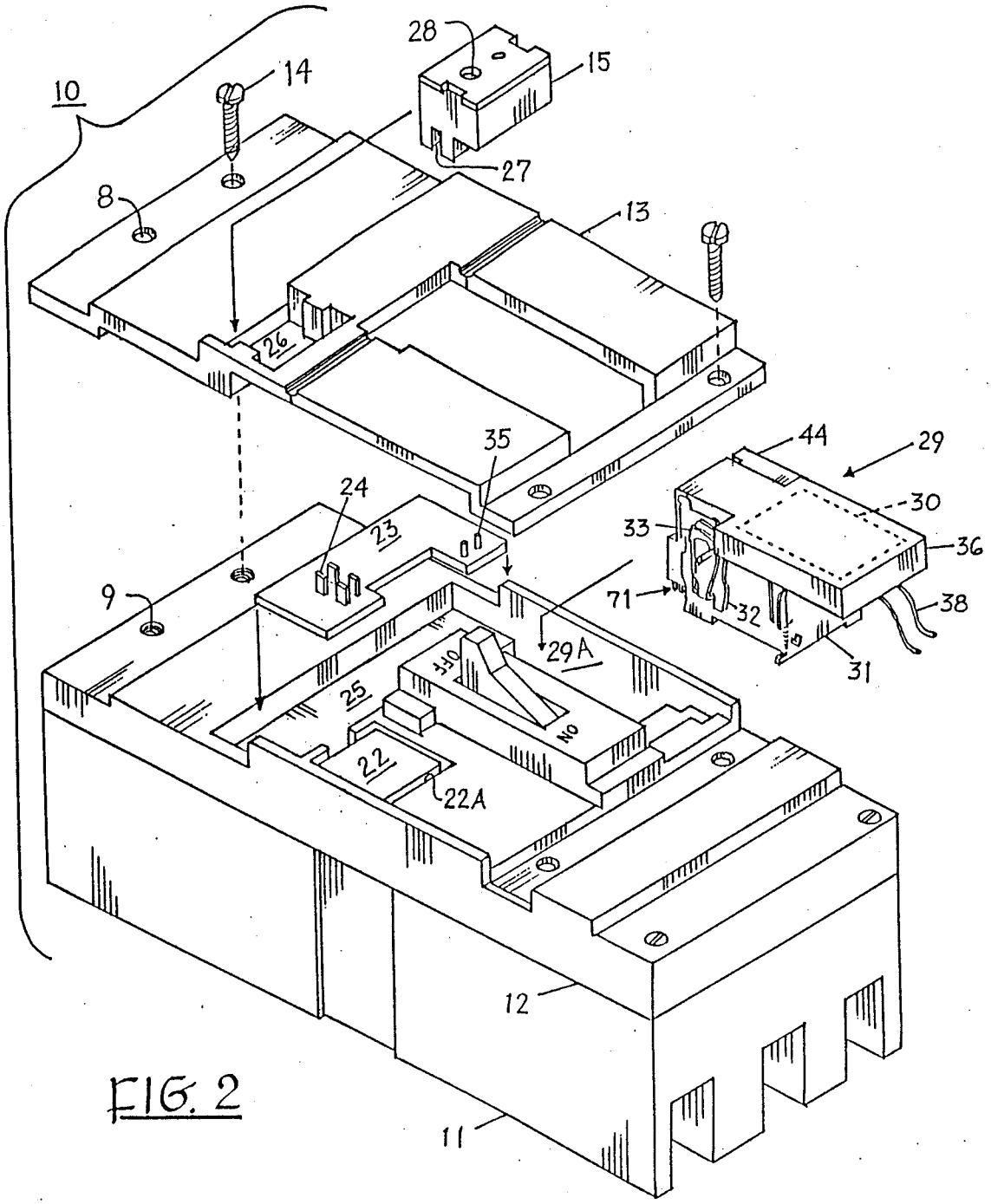
FIG. 2 is an exploded top perspective view of the integrated circuit breaker of FIG. 1 prior to assembly of the combined actuator-accessory unit and bell alarm.

An electronic trip circuit breaker 10 consisting of a molded plastic case 11 with a molded plastic cover 12 is shown in FIG. 1 with the accessory cover 13 attached to the circuit breaker cover by means of screws 14. The case includes a wiring slot 18 formed therein for allowing external connection with a remote switch or alarm. The circuit breaker operating handle 19 extends up from an access slot 20 formed in the cover escutcheon 21. A rating plug 15 such as described in U.S. Pat. No. 4,728,914 entitled "Rating Plug Enclosure for Molded Case Circuit Breakers", which Patent is incorporated herein for reference purposes, is shown assembled within the accessory cover. A pair of accessory doors 16, 17 are formed in the accessory cover for providing access to the combined electromagnetic actuator and multiple accessory unit 29, hereafter "actuator-accessory unit" and the auxiliary switch 22 shown behind the accessory doors. The rating plug 15 is fitted within a recess formed in the accessory cover 13 and the accessory cover is fastened to the circuit breaker cover by means of screws 14, thru-holes 8 and threaded openings 9 as shown in FIG. 2. Access to the rating plug interior for calibration purposes is made by means of the rating plug access hole 28.

Figure 3:
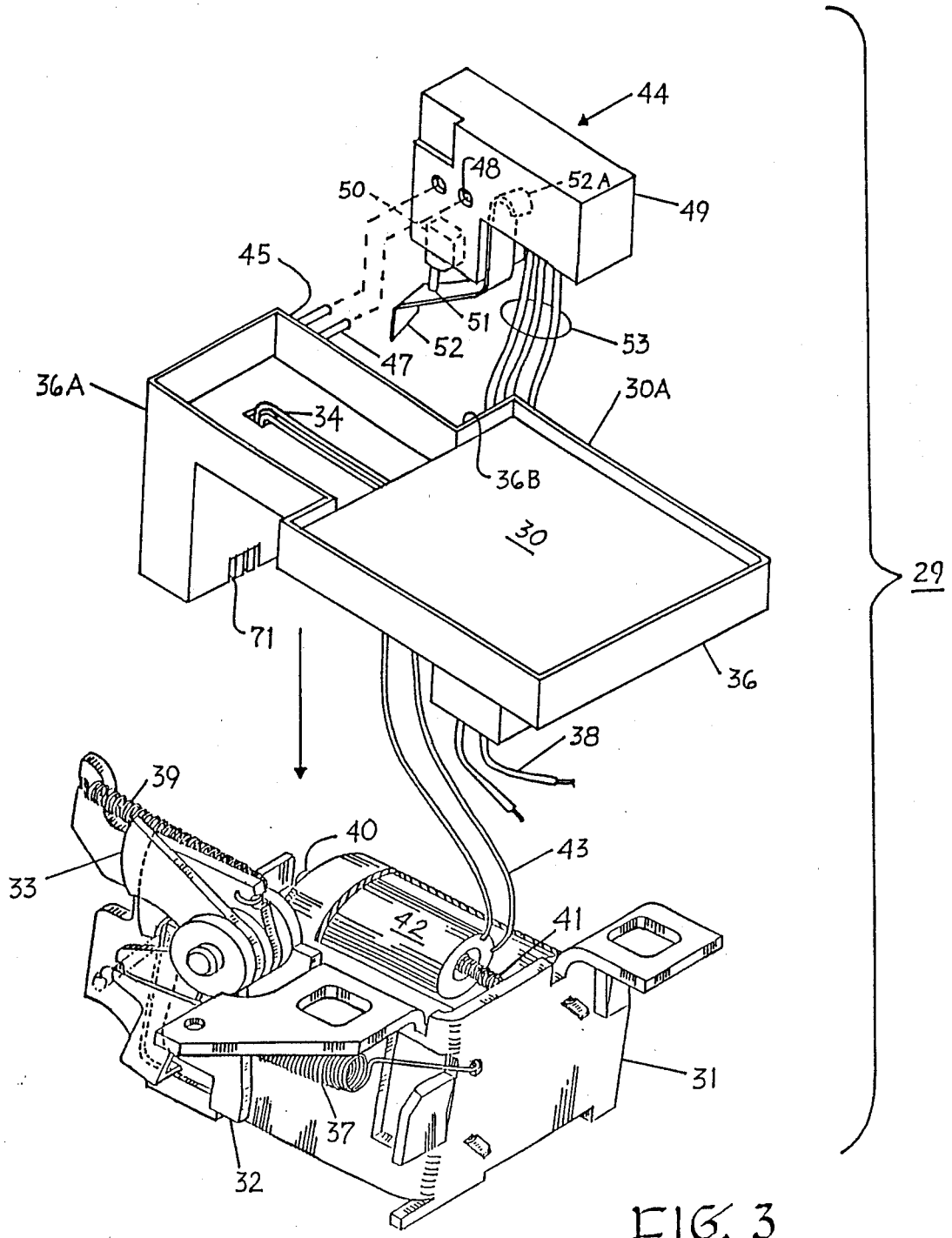
FIG. 3 is a top perspective view of the actuator-accessory unit and bell alarm of FIG. 2 prior to assembly.

The trip unit for the circuit breaker is contained within a printed wire board 23 shown in FIG. 2 which is positioned in the trip unit recess 25. The rating plug 15 when inserted within the rating plug recess 26 interconnects with the printed wire board by means of pins 24 upstanding from the printed wire board and sockets 27 formed on the bottom of the rating plug. The pins 35 upstanding from the trip unit printed wire board connect with the actuator electronics printed wire board 30 by means of sockets 71 formed on the bottom of the actuator-accessory unit cover 36 and conductors 34 (FIG. 3). External electrical connection with the actuator-accessory electronics printed wire board 30 is made by means of conductors 38. The auxiliary switch 22 is positioned within the auxiliary switch recess 22A and is similar to that described in aforementioned U.S. Pat. No. 4,794,356 entitled "Molded Case Circuit Breaker Auxiliary Switch Unit". When the auxiliary switch and trip unit printed wire board have been assembled within their appropriate recesses, the actuator-accessory unit 29 is then installed within the actuator-accessory unit recess 29A. As shown in FIGS. 2 and 3, the actuator-accessory unit 29 consists of a metallic housing 31 through which the trip actuator latch 32 and armature reset lever 33, hereafter "reset lever", extend and within which the actuator-accessory coil 42 is enclosed. The actuator-accessory unit top piece 36 containing the actuator-accessory electronics printed wire board 30 is attached to the top of the housing 31. The reset spring 37 and the take-up spring 39 control the operation of the reset lever 33 and the actuator latch 32 in the manner described within aforementioned U.S. patent application Ser. No. 240,885 filed Sept. 6, 1988, which Application is incorporated herein for purposes of reference. The housing 31 also contains an armature 40 and armature spring 41 which projects the armature in a forward trip position against the holding force provided by the energized actuator-accessory coil 42 which connects with the actuator-accessory electronics printed wire board over conductors 43. A bell alarm 44 is located within a bell alarm recess 45 defined between the junction between the extension 36A on the plastic top piece 36 and the end 36B of the accessory electronic printed wire board recess 30A. The bell alarm is supported within the recess by capturing a pair of pins 47 integrally-formed with the plastic top piece 36 within a pair of thru-holes 48 formed through the plastic bell alarm housing 49. The bell alarm includes a microswitch 50 which is encapsulated within the plastic bell alarm housing such that the switch button 51 extends external from the housing. An S-shaped return spring 52 is positioned under the switch button and is supported on the bell alarm by encapsulating one end 52A within the plastic bell alarm housing. Electrical connection with the bell alarm is made by wire conductors 53 which are also encapsulated within the plastic bell alarm housing for providing strain relief to the switch 50 contained therein. When the bell alarm is positioned within the bell alarm recess 45 and is supported upon the pins 47, any external strain applied to the wire conductors is transmitted through the bell alarm plastic housing 49 to the end 36B of the plastic top piece 36 and against the interior surface of the circuit breaker cover.

Figure 4:
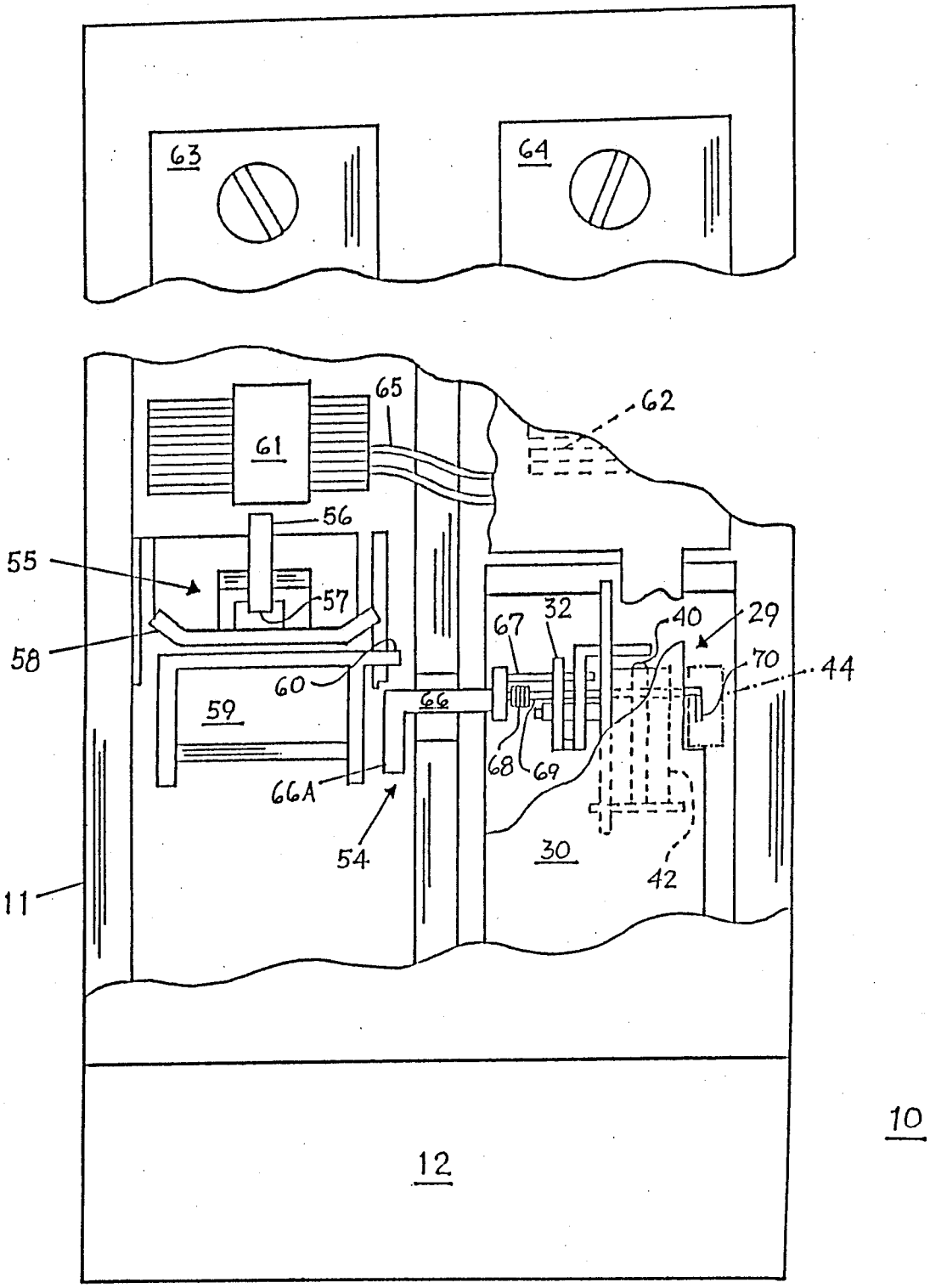
FIG. 4 is a plan view of the circuit breaker of FIG. 1 with the bell alarm of the invention indicated in phantom.

The operation of the bell alarm is best seen by reviewing the operation of the actuator-accessory unit 29 depicted in FIG. 4 within the circuit breaker 10 with part of the actuator-accessory unit printed wire board 30 and cover 12 removed. The bell alarm 44 is depicted in phantom to show the location of the bell alarm relative to the actuator-accessory unit 29 which sits in the circuit breaker cover 12 and the mechanical actuator 54 which extends between the circuit breaker cover 12 and the breaker case 11. The circuit breaker operating mechanism shown generally at 55 includes a cradle 56 having a hook 57 formed at one end thereof which is retained by means of a primary latch 58. The secondary latch 59 prevents the primary latch from releasing the cradle until the secondary latch is displaced by contact with a tab 60 extending from the secondary latch. Electric current flow is sensed by a pair of current transformers 61, 62 which are located ahead of load lugs 63, 64. The current transformers connect with the trip unit printed wire board 23 (FIG. 2) by means of conductors 65. The operating lever 66 sits within the circuit breaker case and carries a latch pin 67 as well as an elongated latch lever 69. The latch pin is retained by the trip actuator latch 32 which interfaces with the actuator-accessory coil armature 40 in the following manner. When the circuit current exceeds a predetermined value, the holding current to the actuator-accessory coil 42 is interrupted thereby allowing the armature to be propelled by the urgence of the armature spring and to thereby rotate the trip actuator latch 32 in the clockwise direction about pivot to release latch pin 67 thereby allowing the operating lever 66 to rotate under the urgence of a powerful trip spring 68 arranged around the elongated latch lever 69 to drive the end 66A of the operating lever into contact with tab 60. The secondary latch 59 and primary latch 58 thereby become displaced to allow the hook 57 to release the cradle 56 thus effectively tripping the cricuit breaker.

Figure 5A:
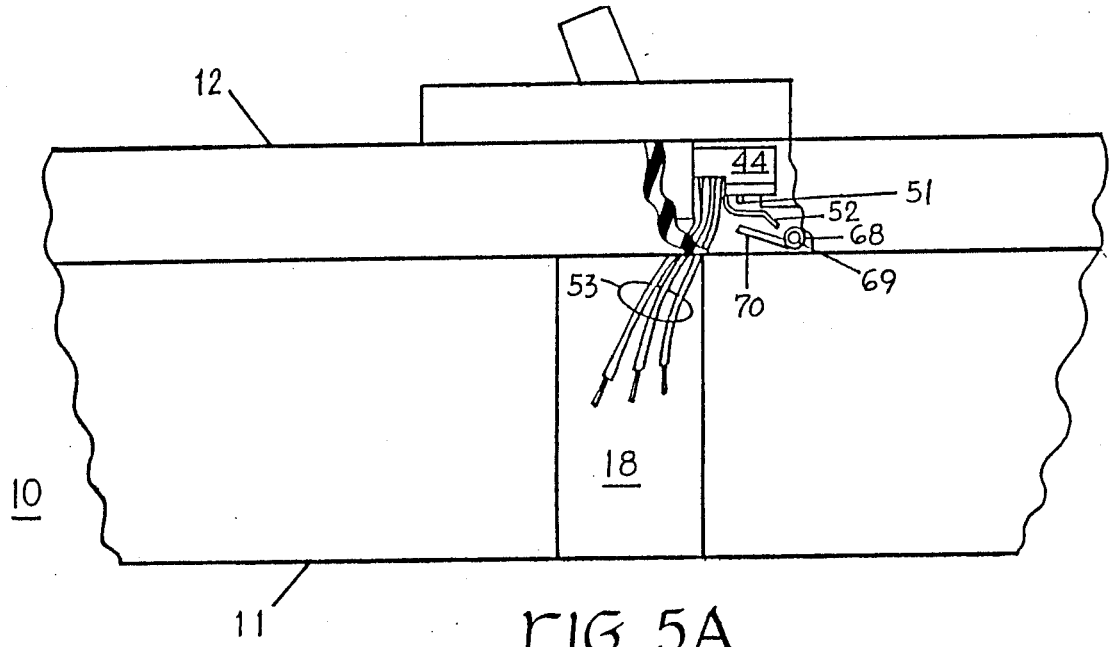
FIGS. 5A and 5B are side views of the electronic circuit breaker of FIG. 1 with a part of the cover removed to depict the bell alarm in the latched and tripped conditions respectively.
Figure 5B:
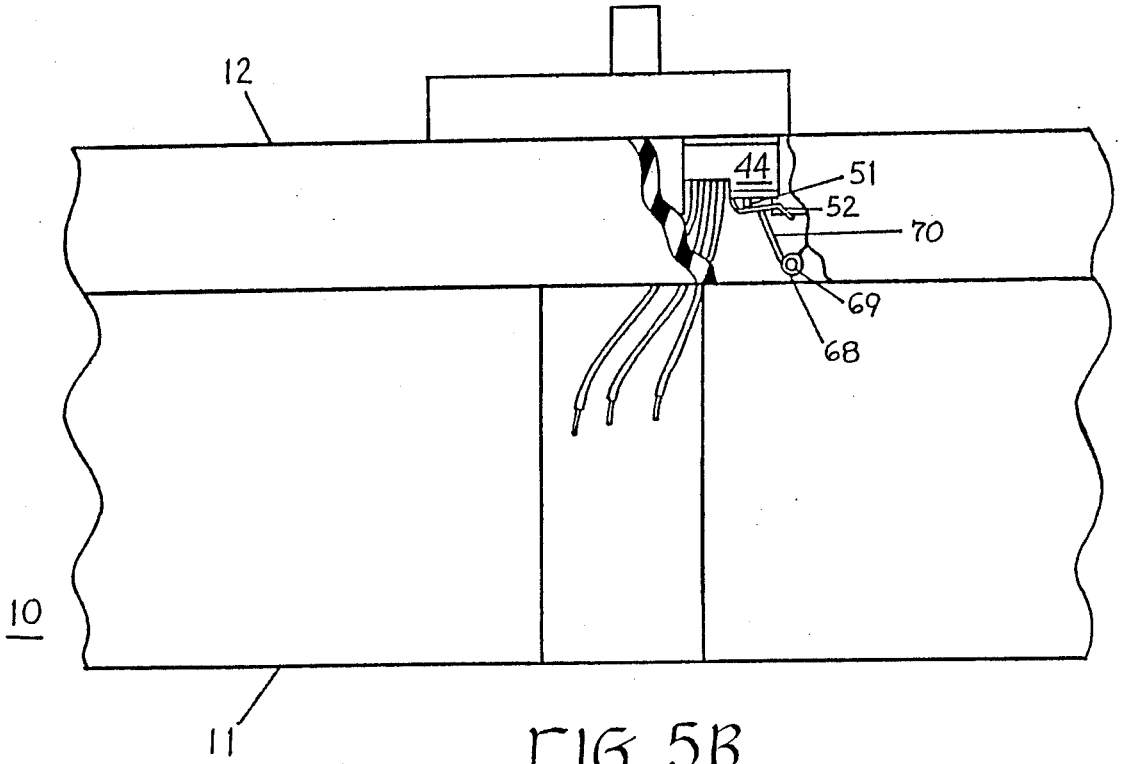

The elongated latch lever 69 includes an upright post 70 that interacts with the bell alarm 44 in the manner best seen by referring now to FIGS. 5A and 5B wherein the circuit breaker 10 is depicted with part of the cover 12 removed to show the interaction of the bell alarm 44 with the circuit breaker operating mechanism through the latch lever 69. The wire conductors 53 exit from the circuit breaker case along the wiring channel 18 formed in the side of the circuit breaker case 11 to connect the bell alarm with an external bell. The circuit breaker is depicted in FIG. 5A in its "ON" condition with the latch lever 69 and latch lever post 70 away from the bell alarm return spring 52 and switch button 51. As described earlier, the powerful trip spring 68 arranged around the latch lever 69 is biased for rotation in the clockwise direction as viewed in FIGS. 5A and 5B. Upon the occurrence of an overcurrent condition the circuit breaker operating mechanism becomes articulated as described earlier with reference to FIG. 4, while at the same time the elongated latch lever 69 rotates rapidly in the clockwise direction as the circuit breaker approaches the tripped condition indicated in FIG. 5B. The trip spring 68 as shown in FIG. 5B has rotated the elongated latch lever 69 and post 70 such that the post 70 drives the bell alarm return spring into contact with the switch button 51 to actuate the bell alarm 44 which in turn energizes the remote bell to give immediate indication of the tripped condition of the circuit breaker.

Having thus described our invention, what we claim as new and desire to secure by Letters Patent is:

1. An electric circuit interrupter comprising in combination:

a circuit interrupter case and cover;

a pair of separable contacts and an operating mechanism supported within said circuit interrupter case;

an electronic trip unit within said circuit interrupter cover for controlling operation of said operating mechanism to separate said contacts upon occurrence of an overcurrent condition through said contacts;

an actuator unit connecting with said trip unit and interacting with said operating mechanism in response to overcurrent signals generated by said trip unit;

a bell alarm within said circuit interrupter cover and interacting with said operating mechanism to provide remote indication of the condition of said contacts;

said bell alarm comprising:

a molded plastic body member;

an electric switch partially embedded within said body member and having a button extending beyond said body member for ON-OFF operation of said switch;

a double-ended spring interfacing with said button at one end and having an opposite end embedded within said body member; and at least one wire conductor having one end connecting with said electric switch and at least part of said wire conductor being partly embedded within said body member to provide strain relief to said end connecting with said switch.

2. The electric circuit interrupter of claim 1 wherein said body member includes attachment means integrally-formed therein.

3. The electric circuit interrupter of claim 1 wherein said bell alarm is attached to said actuator unit.

4. The electric circuit interrupter of claim 3 wherein said actuator unit includes means for receiving said bell alarm attachment means.

5. The electric circuit interrupter of claim 2 wherein said body member attachment means comprises a pair of thru-holes.

6. The electric circuit interrupter of claim 5 wherein said actuator means comprises a corresponding pair of posts.

7. The electric circuit interrupter of claim 6 wherein said posts are integrally-formed within said actuator unit.

8. The electric circuit interrupter of claim 7 wherein said actuator unit includes a plastic top unit.

9. The electric circuit interrupter of claim 8 wherein said posts are formed within said top unit.

* * * * *